United States Patent [19]

Lacoste

[11] Patent Number: 4,662,266

[45] Date of Patent: May 5, 1987

[54] DEVICE FOR AUTOMATICALLY LOADING AMMUNITION IN A CANNON

[75] Inventor: Bernard Lacoste, Valenciennes, France

[73] Assignee: Fives-Cail Babcock, Paris, France

[21] Appl. No.: 783,925

[22] PCT Filed: Feb. 14, 1985

[86] PCT No.: PCT/FR85/00026

§ 371 Date: Sep. 20, 1985

§ 102(e) Date: Sep. 20, 1985

[87] PCT Pub. No.: WO85/03769

PCT Pub. Date: Aug. 29, 1985

[51] Int. Cl.[4] ..... F41D 10/34; F41D 10/38

[52] U.S. Cl. ..... 89/45; 89/33.02

[58] Field of Search ..... 89/45, 47, 33.04, 33.05, 89/33.02, 33.17, 33.1

[56] References Cited

U.S. PATENT DOCUMENTS

| | | | |
|---|---|---|---|
| 1,517,758 | 12/1924 | Schneider | 89/47 |
| 2,460,384 | 2/1949 | Haas | 89/33.05 |
| 2,474,975 | 7/1949 | Goodhue | 89/33.14 |
| 2,700,539 | 1/1955 | Aldrin | 89/47 |
| 2,809,561 | 10/1957 | Edmund | 71/33 |
| 2,870,678 | 1/1959 | Girouard et al. | 89/47 |
| 2,988,962 | 6/1961 | Finn | 89/45 |
| 3,122,967 | 3/1964 | Johnson et al. | 89/46 |
| 3,134,301 | 5/1964 | Even | 89/33.02 |
| 3,602,089 | 8/1971 | Beau Frere | 89/47 |
| 3,618,452 | 11/1971 | Smith et al. | 89/47 |
| 4,457,209 | 7/1984 | Scheurich et al. | 89/47 |

FOREIGN PATENT DOCUMENTS

| | | | |
|---|---|---|---|
| 0051119 | 12/1982 | European Pat. Off. | 89/47 |
| 2214745 | 9/1973 | Fed. Rep. of Germany | 89/45 |
| 2540236 | 8/1984 | France . | |
| 2543285 | 9/1984 | France | 89/45 |

*Primary Examiner*—Stephen C. Bentley
*Assistant Examiner*—Stephen Johnson
*Attorney, Agent, or Firm*—Kurt Kelman

[57] ABSTRACT

The invention concerns devices serving to load ammunition in a cannon consisting of a tube comprising a housing and a rotor in which are arranged several recesses distributed uniformly about its axis and each intended to receive a shell, a door which when closed prevents a shell from exiting the tube, a rammer driven by springs cocked by the recoil of the breech and a lock serving to maintain the springs in the cocked position. To enable the automatic sequence of all the shell loading operations at a single command, the device of the invention comprises motors (16, 18, 20) serving to rotate the tube (10) step by step, to open the door of the tube and to lock it in the closed position, and to release the bolt of the rammer (12), means for controlling these motors in a given sequence at a loading order given by the operator and means for detecting a shell exiting the tube and for detecting the closing of the door.

11 Claims, 6 Drawing Figures

FIG.4
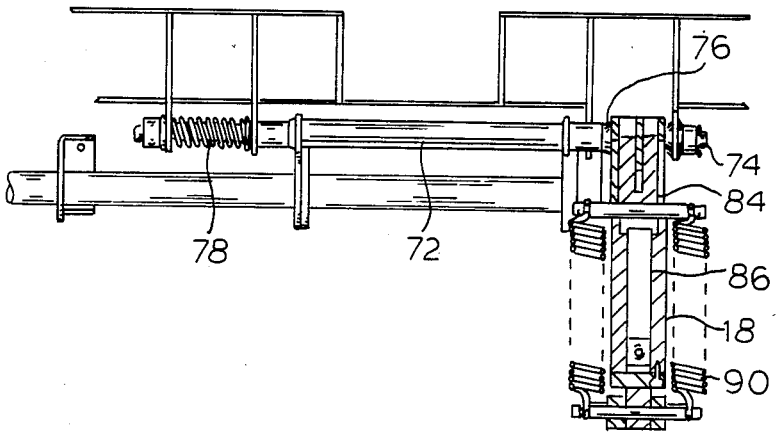
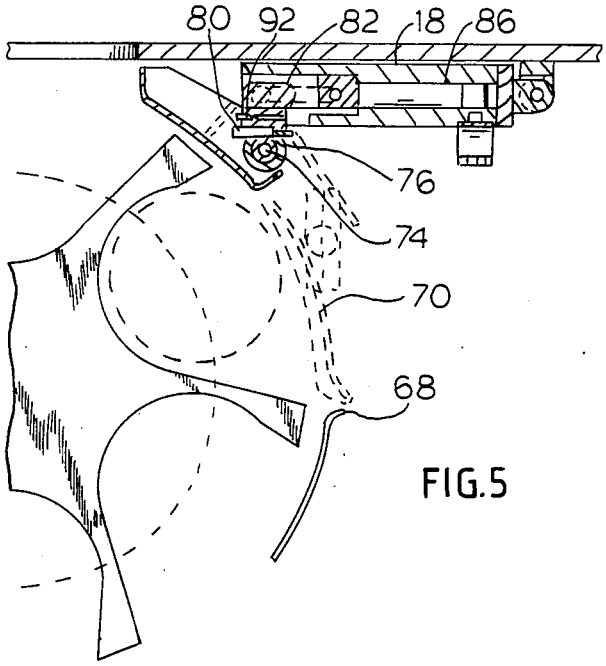
FIG.5

DEVICE FOR AUTOMATICALLY LOADING AMMUNITION IN A CANNON

This invention concerns devices for loading ammunition automatically in a cannon mounted on the turret of an armored vehicle and comprising a tube with a housing and a rotor placed in the housing, in which are arranged several recesses distributed uniformly about its axis, each intended to receive a shell. Means is provided for rotating the rotor of the tube step-by-step to bring each shell successively before a lateral opening in the housing and a door, when closed, prevents the shell from exiting the tube through the opening. A rammer is arranged on the side of the tube, at the rear of the cannon barrel, and intended to receive the ammunition coming out of the tube, through said opening, and to introduce them in the barrel of the cannon. The rammer is operated by springs cocked by the recoil of the breech, a bolt is arranged to hold the springs in the cocked position and means is provided to control the introduction of a shell in the cannon barrel by releasing the bolt.

In known devices, the operation of the door closing the opening in the housing, the rotation of the tube and the release of the bolt of the rammer are carried out manually. All these operations, particularly the rotation of the tube, require a physical effort made difficult by the small space available inside the turret and are time consuming, which may be detrimental to effective firing.

Furthermore, the mechanical linkages between the control elements directed by the operator and the driven linkages clutter up the inside of the turret and further reduce the available space.

To remedy these drawbacks, it has been proposed to motorize the tube. This motorization leads to a substantial improvement in firing conditions, but the gain in time remains small for the different operations are always controlled or performed manually one after the other.

The aim of this invention is to free the operator from any concern relating to mechanical operation by producing an automatic sequence of all shell loading operations at a single command and to permit an appreciable gain of time in these operations.

The loading device according to this invention comprises a first motor serving to rotate the tube step-by-step, a second motor serving to open the door closing the opening of the tube housing and to lock it in the closed position, a third motor serving to release the bolt of the rammer, means for controlling the second motor and opening the door at the loading command given by the operator, means for detecting the shell exiting from the tube, after the door is opened, and for commanding the second motor to close the door, means for detecting the closing of the door and for commanding the first motor to rotate the rotor of the tube, the third motor to release the bolt of the rammer, and means for stopping the first motor after the rotor of the tube has rotated through an angle equal to one step of the first motor.

The motors can be hydraulic and controlled by electric or electro-valves.

Emergency mechanical means are provided for manual control of the tube's rotation, the opening of the housing door and the rammer bolt.

The motor of the tube can consist of a hydraulic jack and a cam and roller system transforming the rectilinear reciprocating movement of the jack piston to a step-by-step rotation, of the type described in the French patent No. 83.01309.

The second motor can consist of a single acting hydraulic jack acting on the door of the tube housing, which is pivoted by means of a pushrod guided rectilinearly and a cam made solidary in rotation with the door. Return springs acting on said pushrod bring it and the jack piston back to the retracted position, when the jack is not under oil pressure, which makes it possible to close the door under the action of its own weight. To lock the door in the closed position, the pushrod is equipped with a tang preventing the rotation of the cam and hence the opening of the door when the pushrod is in the retracted position. A clutch coupling is provided between the cam and the door to permit manual opening of same.

The third motor can consist of a single acting hydraulic jack acting on a rod or cable connected to the rammer bolt. It is possible, in particular, to use a jack whose piston is made of a tube inside which passes a cable or rod connected to the bolt and acting on a stop fixed at the end of the cable or rod. A control element fixed on the same end of the cable or rod serves to release the bolt manually.

Other features of the invention will become apparent from the following description given in reference to the attached drawings which show one embodiment of the invention, by way of non limiting example, and in which:

FIG. 4 is a view in partial section and partial elevation of the control system for the door of the tube;

FIG. 5 is a transverse section of a tube showing the door control system.

Figure 1:
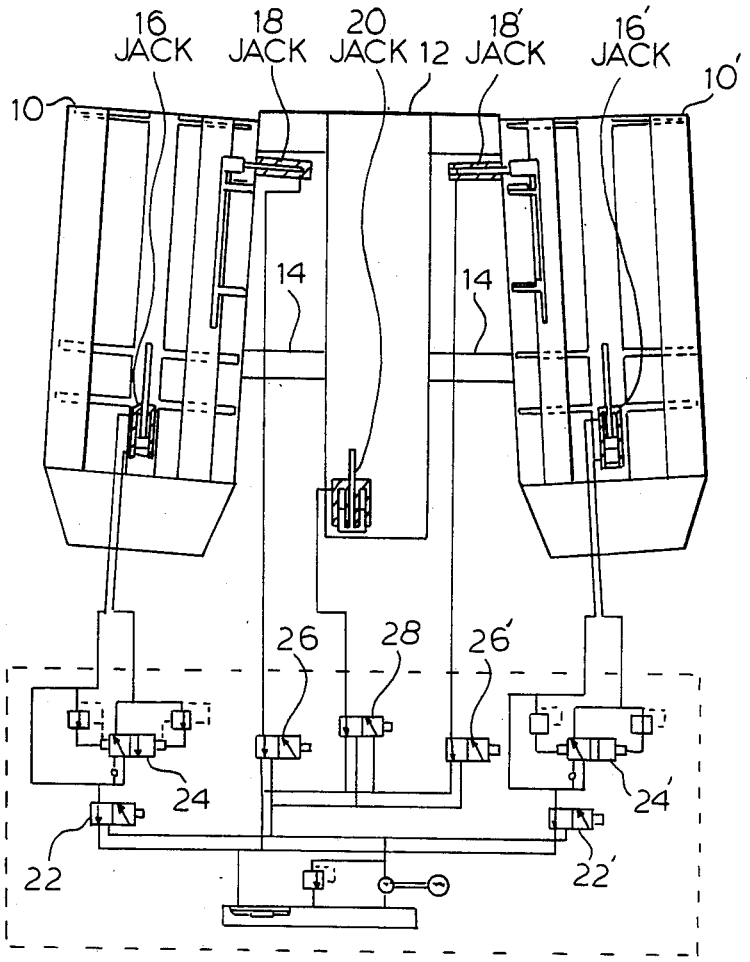
FIG. 1 is a schematic representation of a two tube ammunition loading device according to the invention.

The loading device represented schematically in FIG. 1 comprises two tubes 10 and 10' installed on either side of the rammer system 12 introducing the ammunition in the common barrel and ejecting the shell cases. By means of springs, this element serves to load ammunition in the breech of the cannon barrel. During the recoil of the barrel, the springs are compressed; they are then held in this state by a tang acting as a lock. The ammunition stored in the tubes is then brought individually to the rammer by means of the ramps 14, 14'. By acting on the tang the springs are released and the shell is pushed into the cannon barrel by the rammer.

FIG. 1 illustrates the jacks 16, 16' which control the step-by-step rotation of the tubes, the jacks 18, 18' controlling the opening of the doors closing the lateral openings of the tube housings and the jack 20 acting on the rammer springs retaining tang to control the introduction of a shell in the cannon barrel. The electro-valves 22-22', 24-24', 26-26' and 28 controlling the oil inlet in the chambers of these jacks are also represented.

Figure 2:
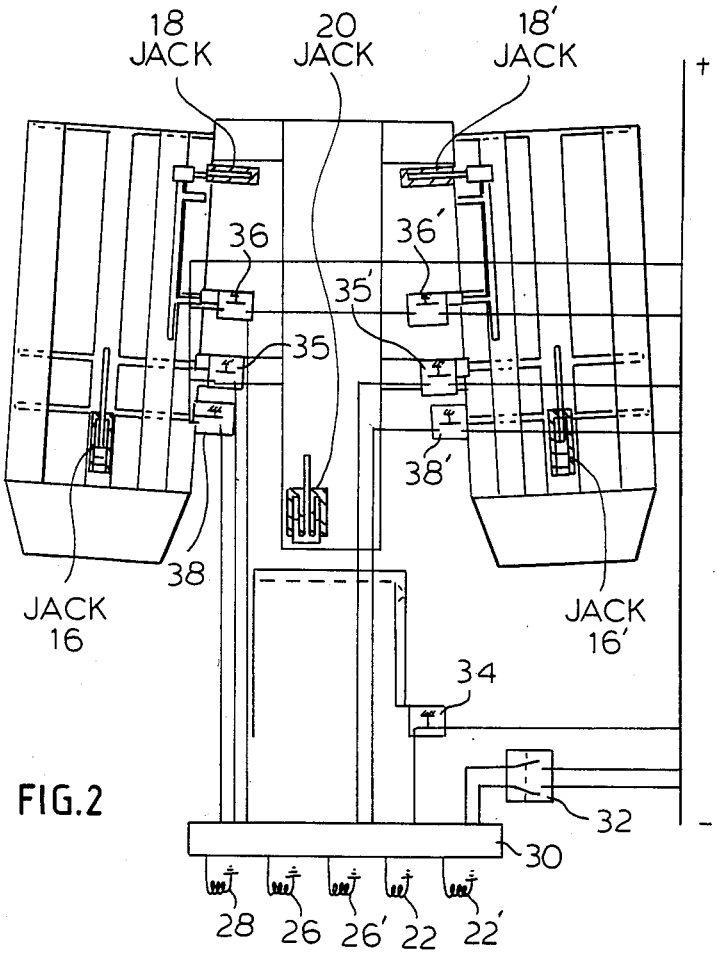
FIG. 2 illustrates an electrical control diagram for the electro-valves of the device of FIG. 1.

FIG. 2 shows the electrical circuit which controls the electro-magnets controlling the electro-valves. The coils are connected to an electrical source through a processor 30, consisting of a set of logical circuits, which controls the loading operations in the order and conditions indicated below.

When the operator wishes to load a shell in the cannon barrel, he selects the tube from which the shell is to be extracted and gives the order to load by means of a switch 32. This order is executed only if the breech is open and empty, the switch 34 being then closed. The processor 30 first controls the opening of the door of the tube selected by means of the jack 18 or 18'. While passing over the corresponding ramp 14 or 14', the shell actuates the switch 35 or 35' and the processor then cuts the power to the jack 18 or 18' so that the door can close. This is detected by the sensor 36 or 36' and as soon as the processor 30 receives the information it controls the rotation of the tube, by means of the jack 16 or 16', and releases the rammer by means of the jack 20. As soon as the shell has been introduced in the breech and the breech is closed, the switch 34 opens and prevents operation of the loading device. An operation terminating switch 38 or 38' cuts the power to the jack 16 or 16' after the tube rotor has turned by one step to bring another shell before the housing opening.

The processor is designed to control each operation individually or certain of these, for example the rotation of the tube.

Figure 3:
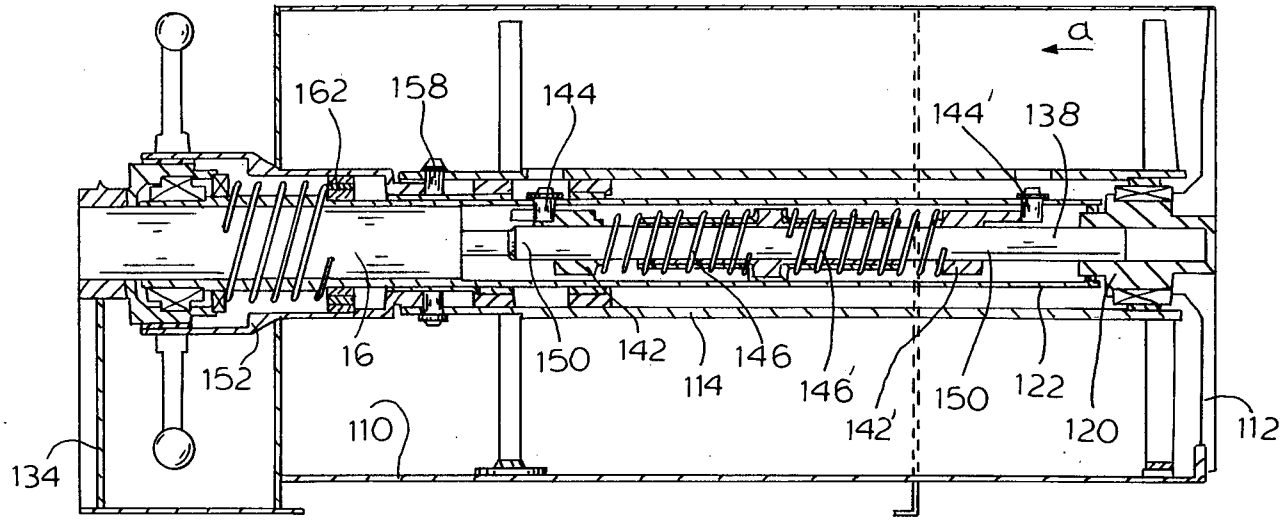
FIG. 3 is a longitudinal section of a tube.

FIG. 3 shows, by way of example, one embodiment of the step-by-step motor which causes the tube rotor to rotate. The tube is composed of a housing 110, closed at one end by a bottom plate 112, and of a rotor formed of a tubular shaft 114 on which are mounted six-pointed stars forming six recesses distributed uniformly about the axis of the tube and intended to receive the ammunition.

The tube rotor is supported at its end adjacent to the bottom plate 112 by a roller bearing mounted on a part 120 fixed to the bottom plate 112. The shaft 114 is also supported on a tube 122 which is supported at its ends by roller bearings mounted on the part 120 and on a support 134 integral with the tube housing.

A jack 16 and a splined shaft 138, one end of which is fixed to the jack piston, coaxially extend are placed inside the tube 122. The jack is fixed to the support 134 and the splined shaft is mounted to slide within a bore of the part 120 equipped with splines to prevent the shaft 138 from rotating.

Two annular cams 142 and 142' are mounted to slide on the shaft 138 by means of sleeves splined to prevent the cams from rotating about the shaft. These cams have a saw tooth profile and are mounted on the shaft in such manner that the points of the teeth of each of them are directed towards the adjacent end of the shaft 138. Each cam comprises three teeth and the teeth of one cam are staggered angularly by a half step with respect to the teeth of the other cam.

Each cam cooperates with a roller 144, 144' whose axis is fixed radially on the tube 122, the axes of the two rollers being aligned on a same generatrix of the tube. When the piston of the jack 16 is in one of its end positions, the cams are maintained in contact with the respective rollers by springs 146, 146' compressed between the cams and a lock ring fixed on the shaft 138. One of the rollers, roller 144 in FIG. 3, is then at the bottom of the teeth and the other is at the top of a tooth. When the piston of jack 16 and the shaft 138 are moved to the right, from the position they occupied in FIG. 3, the cams 142, 142' remain in their initial positions until a ring 150 seated in a throat of the shaft 138 comes to bear against the cam 142. This is then driven by the shaft 138 and the roller 144 is released from the bottom of the teeth of this cam, which allows the tube 122 to rotate. Under the action of the spring 146' which pushes the cam 142' against the roller 144', the tube 122 rotates until the roller arrives at the bottom of the teeth of this cam, which corresponds to a rotation of one-sixth of a revolution.

The tube 122 is then locked in its new position and it cannot rotate, through the same angle, until the piston of jack 16 and the shaft 138 are moved in the opposite direction.

The rotation of the tube 122 is transmitted to the tubular shaft 114 of the tube by a sleeve 152 arranged concentrically with the tube 122 and supported by it and by the support 134 by means of bearings. This sleeve is coupled to the shaft 114 by rollers 158 mounted on the shaft and lodged in longitudinal openings of the sleeve. The sleeve is furthermore coupled to the tube 122 by a toothed coupling 162 which can be released by axial movement of the sleeve along the tube. A handwheel 166 fixed on the sleeve serves to cause the rotation of the tube rotor, after the coupling 162 has been released.

FIGS. 4 and 5 show an embodiment of the control and locking system for the door 70 closing the lateral opening 68 of the tube housing. This door is pivoted and formed of fingers fixed to a tube 72 mounted on a fixed axis 74 parallel to the axis of the tube.

At one of its ends, the tube 72 is provided with teeth engaging in notches of complementary form cut out from the adjacent end of tube 76 of same diameter as the tube 72 and also mounted on the shaft 74. A helicoidal spring 78 exerts an axial thrust on the tube 72 and keeps it contact with the end of tube 76 which bears against a support tab of the shaft 74.

The end of the tube 76 is fixed to cam 82 by a key 80, and pushrod 84 which is itself pushed by the piston 86 of the jack 18, acts on cam 82. When the jack is under oil pressure, the movement of the piston 86 causes the door to open. Return springs 90 hold the pushrod and the piston in the retracted position when the jack is not under oil pressure. The pushrod 84 comprises a tang 92 which, when it is in the retracted position, prevents the rotation of the cam 82 and locks the door in the closed position.

The door can however be lifted manually, to clear the opening 68, by moving it parallel to the axis of the tube, against the action of the spring 78, so as to release the end of the tube 72 from the end of the tube 76, and causing it to rotate about the shaft 74.

Figure 6:
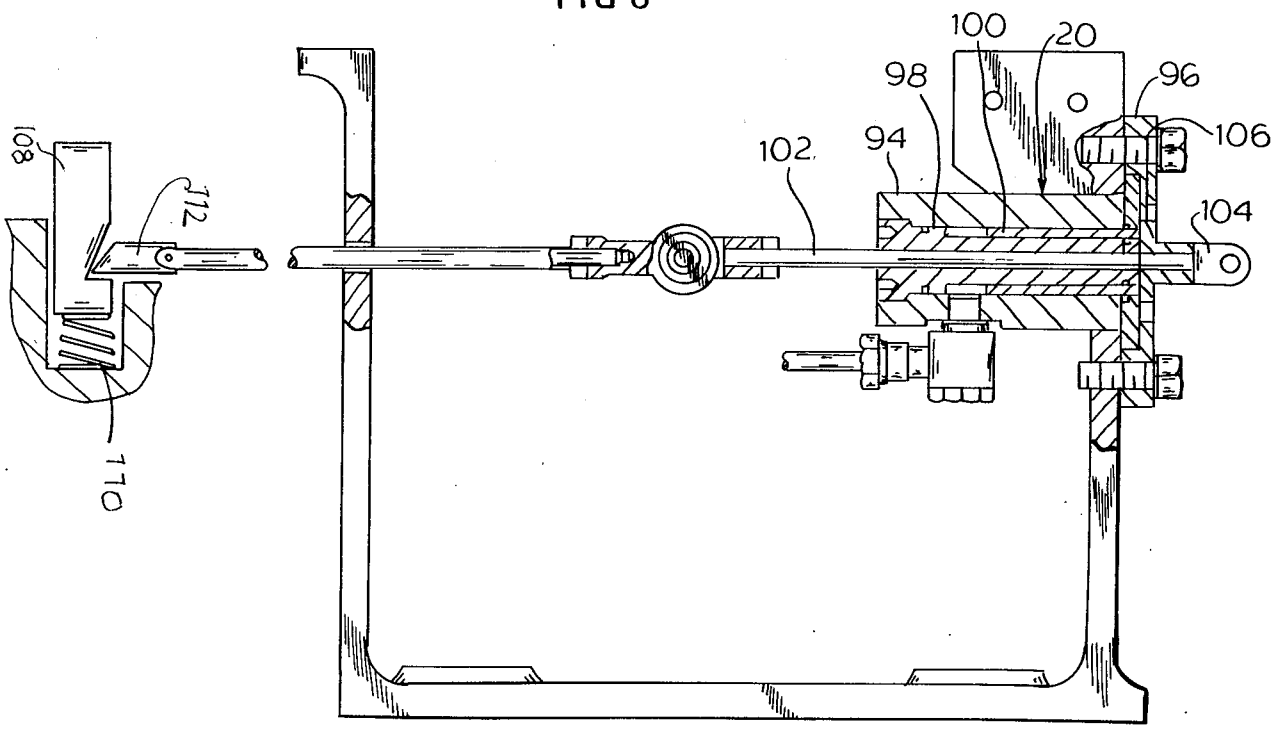
FIG. 6 is a longitudinal section of the rammer bolt control jack.

FIG. 6 shows an embodiment of the jack 20 controlling the rammer 108 biased by spring 110. The jack comprises a cylindrical body 94 fixed to a stationary support by means of a flange 96 and a core 98 sealed at one end of the body 94 and forming with it a chamber of annular section in which a tubular piston 100 is seated. Sealing gaskets are mounted in the bore of the body of the jack and on the core, at the open end of the chamber. The core 98 is pierced by an axial passage in which slides a rod 102 connected by a linkage to the bolt 112 of the rammer. The bolt maintains spring 110 in a cocked position. This rod has at its end a coping 104 and a washer 106 on which acts the piston 100 when oil under pressure is admitted in the chamber to release the rammer. A handle mounted directly on the end of the rod 102 or connected to it by a linkage or a cable serves to release the rammer manually, for example if the hydraulic plant supplying the jacks should break down.

Instead of hydraulic jacks, electric motors or electromagnets could be used to rotate the tube, control the opening of the tube door and release the rammer. Hydraulic logical circuits could be used to control these operations.

I claim:

1. A device for automatically loading shells in a cannon barrel, which comprises (a) a tube comprising (1) a cylindrical housing defining a lateral opening and (1) a rotor having an axis and positioned inside the cylindrical housing, the rotor having a plurality of recesses distributed uniformly about the rotor axis for receiving respective ones of said shells, step-by-step rotation of the rotor permitting successive ones of said shells to be moved into alignment with the lateral opening in the cylindrical housing, (b) a first motor for rotating the rotor step-by-step, (c) a door for normally closing the lateral opening in the cylindrical housing, (d) a second motor for opening the door, (e) a rammer means arranged at a side of the tube for receiving the successive shells passing through the lateral opening in the cylindrical housing when the door is opened, the rammer means comprising (1) a rammer element actuated by spring means for introducing the shells into a breech of the cannon barrel and (2) a bolt maintaining the spring means in a cocked position, (f) a third motor for releasing the bolt from the cocked position, (g) a control system responsive to a loading command for successively operating the second motor for first opening the door and then closing it, operating the first motor for rotating the rotor, operating the third motor for releasing the bolt, said control system comprising (1) means for detecting exiting of a respective one of the shells through the lateral opening in the cylindrical housing, (2) means for detecting closing of the door, and (3) means for stopping operation of the first motor after the rotor has rotated through an angle equal to one step, and (h) means for manually controlling the rotation of the rotor, the opening of the door and the release of the bolt.

2. The automatic loading device of claim 1, wherein the rotor comprises a hollow shaft and the first motor is positioned inside the hollow shaft.

3. The automatic loading device of claim 1, wherein the first motor comprises a double-acting hydraulic jack having a rectilinearly reciprocating piston and a cam-and-roller system transforming the rectilinearly reciprocating movement of the piston into a step-by-step rotary movement.

4. The automatic loading device of claim 1, further comprising a manually releasable coupling connecting the first motor to the rotor.

5. The automatic loading device of claim 1, wherein the third motor is single-acting hydraulic jack, and further comprising an elongated element connecting the single-acting hydraulic jack to the bolt.

6. The automatic loading device of claim 5, wherein the single-acting hydraulic jack has a tubular piston, the elongated connecting element passing through the tubular piston and comprising a stop upon which the piston acts when under hydraulic pressure, and further comprising a manually operable control element connected to the elongated connecting element.

7. A device for automatically loading shells in a cannon barrel, which comprises (a) a tube comprising (1) a cylindrical housing defining a lateral opening and (1) a rotor having an axis and positioned inside the cylindrical housing, the rotor having a plurality of recesses distributed uniformly about the rotor axis for receiving respective ones of said shells, step-by-step rotation of the rotor permitting successive ones of said shells to be moved into alignment with the lateral opening in the cylindrical housing, (b) a first motor for rotating the rotor step-by-step, (c) a pivotal door for normally closing the lateral opening in the cylindrical housing, (d) a second motor for pivoting the door to open the lateral opening, the second motor comprising a single-acting hydraulic jack including a pushrod acting on the door under hydraulic pressure to pivot the door, the pushrod being guided in a rectilinear path, a cam acting on the door during pivoting thereof, and return spring means acting on the pushrod for returning it to a retracted position when the pushrod is not under hydraulic pressure, (e) a rammer means arranged at a side of the tube for receiving the successive shells passing through the lateral opening in the cylindrical housing when the door is opened, the rammer means comprising (1) a rammer element actuated by spring means for introducing the shells into a breech of the cannon barrel and (2) a bolt maintaining the spring means in a cocked position, (f) a third motor for releasing the bolt from the cocked position, and (g) a control system responsive to a loading command for successively operating the second motor for first opening the door and then closing it, operating the first motor for rotating the rotor, operating the third motor for releasing the bolt, said control system comprising (1) means for detecting exiting of a respective one of the shells through the lateral opening in the cylindrical housing, (2) means for detecting closing of the door, and (3) means for stopping operation of the first motor after the rotor has rotated through an angle equal to one step.

8. The automatic loading device of claim 7, wherein the second motor further comprises means preventing pivoting of the door when the pushrod is in the retracted position.

9. The automatic loading device of claim 7, further comprising a releasable coupling connecting the cam to the door.

10. The automatic loading device of claim 7, wherein the third motor is a single-acting hydraulic jack, and further comprising an elongated element connecting the single-acting hydraulic jack to the bolt.

11. The automatic loading device of claim 10, wherein the single-acting hydraulic jack has a tubular piston, the elongated connecting element passing through the tubular piston and comprising a stop upon which the piston acts when under hydraulic pressure, and further comprising a manually operable control element connected to the elongated connecting element.

* * * * *